US006292162B1

(12) United States Patent
Shiki

(10) Patent No.: US 6,292,162 B1
(45) **Date of Patent: *Sep. 18, 2001**

(54) DRIVING CIRCUIT CAPABLE OF MAKING A LIQUID CRYSTAL DISPLAY PANEL DISPLAY AND EXPANDED PICTURE WITHOUT SPECIAL SIGNAL PROCESSOR

(75) Inventor: Tatsuya Shiki, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/869,431

(22) Filed: Jun. 6, 1997

(30) Foreign Application Priority Data

Jun. 7, 1996 (JP) ..... 8-145649

(51) Int. Cl.[7] ..... G09G 3/36
(52) U.S. Cl. ..... 345/98; 345/99; 345/100
(58) Field of Search ..... 345/99, 213, 212, 345/127, 131, 132, 103, 98, 100

(56) References Cited

U.S. PATENT DOCUMENTS

| | | | | |
|---|---|---|---|---|
| 4,511,026 | * | 4/1985 | Crossland et al. | 345/99 |
| 4,511,926 | * | 4/1985 | Crossland et al. | 345/99 |
| 4,662,718 | * | 5/1987 | Masubuchi | 345/99 |
| 4,851,826 | * | 7/1989 | Davis | 345/127 |
| 4,908,710 | * | 3/1990 | Wakai et al. | 345/103 |
| 4,952,923 | * | 8/1990 | Tamura | 340/731 |
| 4,985,698 | * | 1/1991 | Mano et al. | 345/103 |
| 5,166,670 | * | 11/1992 | Takeda et al. | 345/98 |
| 5,365,284 | * | 11/1994 | Matsumoto et al. | 345/99 |
| 5,402,149 | * | 3/1995 | Amagami et al. | 345/100 |
| 5,448,259 | * | 9/1995 | Hidaka | 345/99 |
| 5,583,535 | * | 12/1996 | Takarada et al. | 345/99 |
| 5,602,561 | * | 2/1997 | Kawaguchi et al. | 345/100 |
| 5,682,175 | * | 10/1997 | Kitamura | 345/100 |
| 5,731,798 | * | 3/1998 | Shin | 345/99 |
| 5,739,803 | * | 4/1998 | Neugebauer | 345/100 |
| 5,748,167 | * | 5/1998 | Watanabe et al. | 345/99 |
| 5,764,210 | * | 6/1998 | Moon | 345/90 |

FOREIGN PATENT DOCUMENTS

| | | |
|---|---|---|
| 1-158490 | 6/1989 | (JP) . |
| 4-20551 | 7/1992 | (JP) . |
| 7-114359 | 5/1995 | (JP) . |

* cited by examiner

*Primary Examiner*—Jeffery Brier
*Assistant Examiner*—Anthony J. Blackman
(74) *Attorney, Agent, or Firm*—Sughrue, Mion Zinn, Macpeak & Seas, PLLC

(57) ABSTRACT

A driving circuit has a plurality of sample and hold circuits which are connected to data buses of a liquid crystal display panel. The data buses are divided into a plurality of groups. Each of the groups receives a picture signal to drive the data buses. A timing controller controls operation timing of the groups in response to a synchronizing signal and a clock signal to control each of the groups independently of one another.

7 Claims, 16 Drawing Sheets

DRIVING CIRCUIT CAPABLE OF MAKING A LIQUID CRYSTAL DISPLAY PANEL DISPLAY AND EXPANDED PICTURE WITHOUT SPECIAL SIGNAL PROCESSOR

BACKGROUND OF THE INVENTION

This invention relates to a driving circuit which drives a liquid crystal display panel of active matrix type in response to a picture signal so as to display an expanded picture.

Recently, a flat panel display is often used for a display device of a personal computer, an audiovisual equipment, etc. Generally, a liquid crystal display (LCD) is known as the flat panel display.

The liquid crystal display is considerably thinner than a CRT display which has the same size screen. Moreover, the liquid crystal display is considerably lower than the CRT display in electric power consumption. Thus, the liquid crystal display is more attractive than the CRT display.

By the way, it is necessary that the liquid crystal display can deal with various kinds of standardized picture signals like the CRT display in order to generalize the liquid crystal display. In other words, the liquid crystal display must be able to display various pictures which has various standardized resolution.

Resolution of the liquid crystal display is decided by the number of pixels. Accordingly, the number of pixels is decided in consideration of the highest resolution of standardized picture signals displayed on the liquid crystal display. In this case, the number of the pixels is equal to the number of picture data of each frame of the picture signal.

When the number of the picture data is smaller than the number of the pixels, the liquid crystal display must interpolate the picture data in each frame to expand an original picture which corresponds to the picture signal.

A conventional driving circuit has a special signal processor so as to expand the original picture. The special signal processor defines a plurality of drive frames each of which differs from each picture frame and which includes interpolated data in addition to a picture signal of each picture frame. The conventional driving circuit displays both the picture signal and the interpolated data on a liquid crystal display panel within each drive frame.

However, the special signal processor is required to produce the plurality of drive frames from each frame of the picture signal in the conventional driving circuit. Moreover, very complicated control is needed to display the plurality of frames in the conventional driving circuit.

Another conventional driving circuit has a clock multiply circuit which multiplies a system clock signal to produce a multiplied system clock signal. The conventional driving circuit samples a picture signal by use of the multiplied system clock signal to produce a picture data which is equal to the pixels in number.

However, the conventional driving circuit can deal with an analog picture signal but can not deal with a digital picture signal.

SUMMARY OF THE INVENTION

It is an object of this invention to provide a driving circuit which can drive a liquid crystal display panel without a special signal processor so that an expanded picture is displayed on the liquid crystal display panel.

It is another object of this invention to provide a driving circuit which can deal with a digital picture signal.

It is still another object of this invention to provide a driving circuit which can drive a liquid crystal display panel without an expensive frame buffer or an expensive line buffer for interpolated data so that an expanded picture is displayed on the liquid crystal display panel.

It is further still another object of this invention to provide a driving circuit which can accomplish a high quality display in spite of a simple structure.

Other objects of this invention will become clear as the description proceeds.

In order to understand the gist of this invention, it should be noted that a driving circuit is operable in response to a picture signal, a synchronizing signal, and a system clock signal to drive a liquid crystal display panel which has a plurality of data buses.

According to an aspect of this invention, the driving circuit comprises a plurality of sample and hold circuits which are connected to the data buses, respectively, and which are divided into a plurality of groups. Each of the groups receive the picture signal to drive the data buses. Timing control means controls operation timing of the groups of the sample and hold circuits in response to the synchronizing signal and the system clock signal to control each of the groups of the sample and hold circuits independently of one another.

DESCRIPTION OF THE PREFERRED EMBODIMENT

Referring to FIGS. 1 through 4, description will be at first directed to a conventional driving circuit for a better understanding of this invention.

Figure 1:
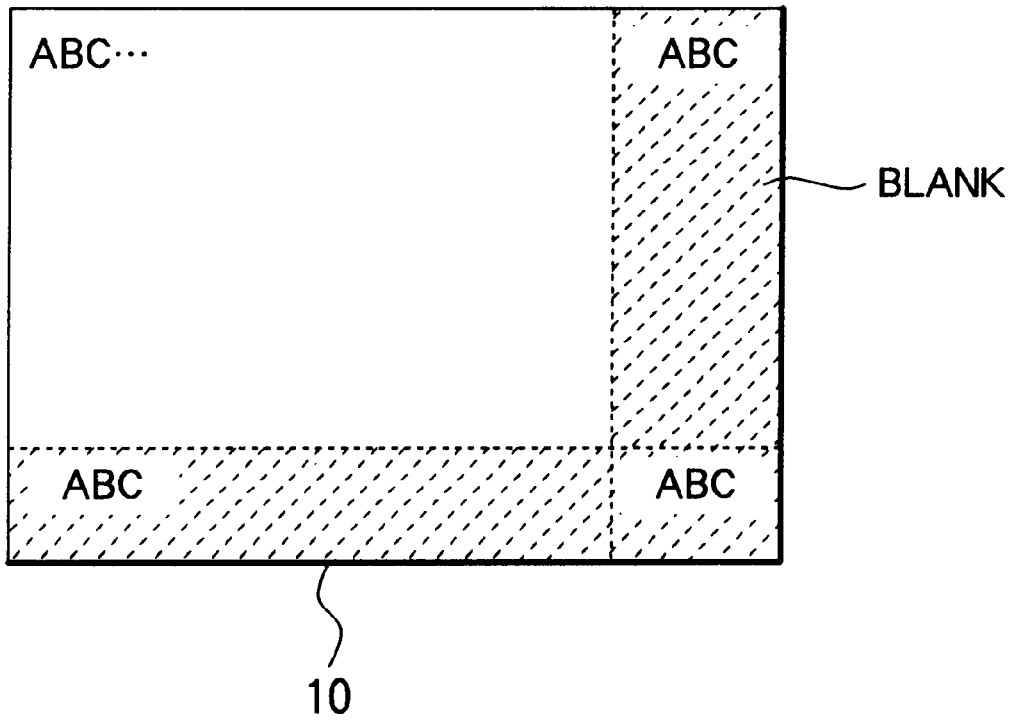
FIG. 1 PRIOR ART
FIG. 1 shows an LCD panel displaying an original picture which does not correspond to a standard of the LCD panel.

In FIG. 1, a liquid crystal display panel 10 has a predetermined number of pixels on the basis of a certain standard. It is assumed that an original picture is represented by picture data which are smaller than the pixels in each frame. If the original picture is displayed on the display panel 10 without interpolation of the picture data, any blank is left on the display panel 10 as shown by hatching in FIG. 1. Moreover, it often happens that the original picture is partially displayed in place of the blank. For example, such a partial display takes place when the display panel 10 is based on a some standard over the VGA (Video Graphics Array) standard for a personal computer display and the original picture is based on the VGA standard. In order to avoid occurrence of the above-mentioned situation, the interpolation is carried out by a driving circuit. Namely, the original picture is expanded and is displayed on the display panel 10.

Figure 2:
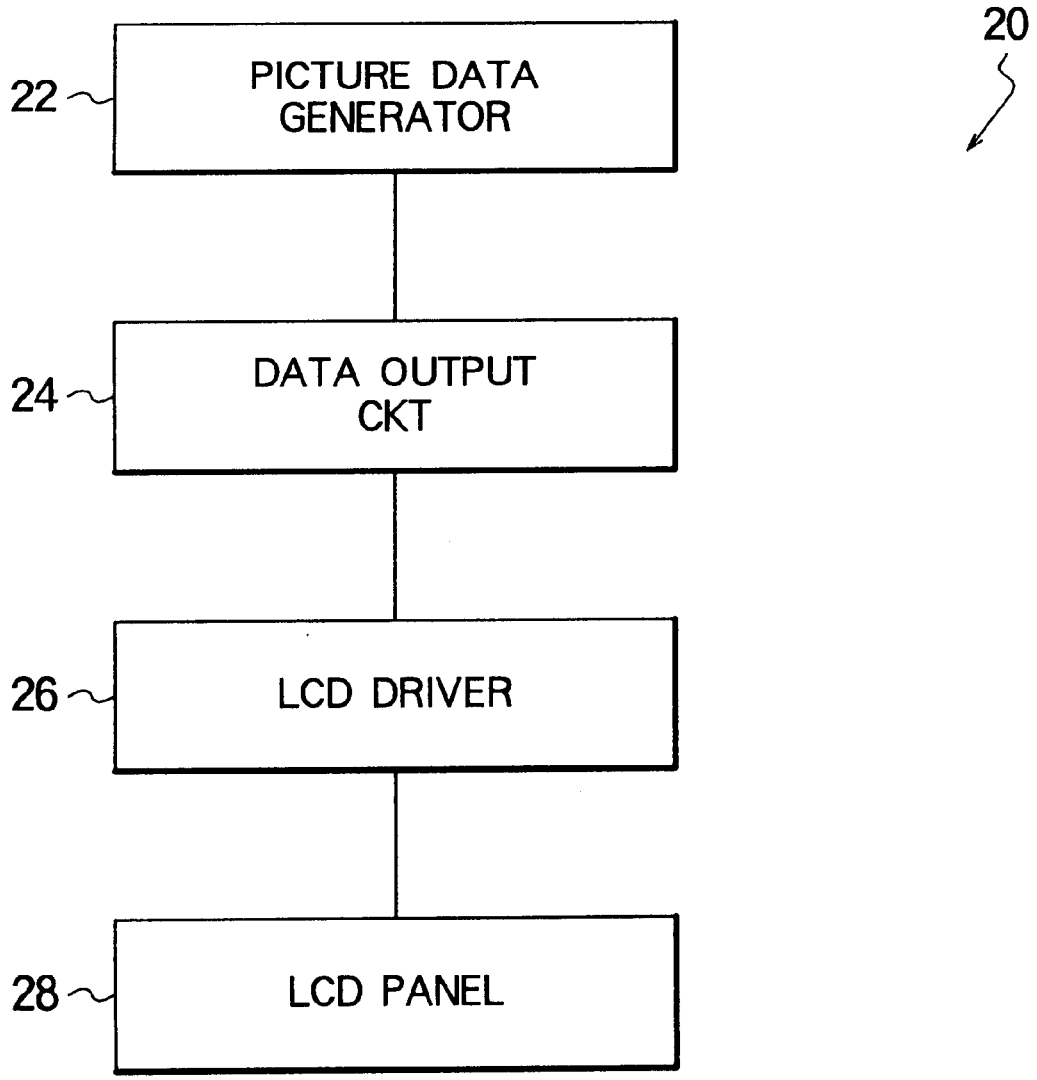
FIG. 2 PRIOR ART
FIG. 2 is a block diagram of a conventional driving circuit.

In FIG. 2, a conventional driving circuit 20 has a picture data generator 22 which produces picture data. A data output circuit 24 interpolates the picture data into interpolated picture data. An LCD driver 26 drives an LCD panel 28 in response to the interpolated picture data.

When the conventional driving circuit 20 expands an original picture in a horizontal direction, the data output circuit 24 and the LCD driver 26 operates as illustrated in FIG. 3.

Figure 3A:
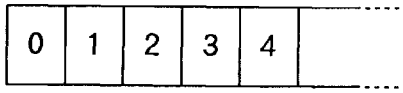
FIG. 3A PRIOR ART
FIGS. 3A through 3E show views for use in describing interpolation operation of the driving circuit of FIG. 2.
Figure 3B:
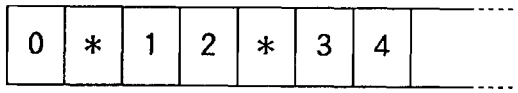
FIG. 3B PRIOR ART
Figure 3C:
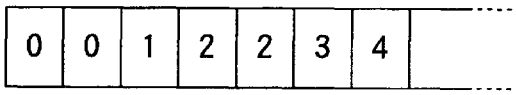
FIG. 3C PRIOR ART
Figure 3D:
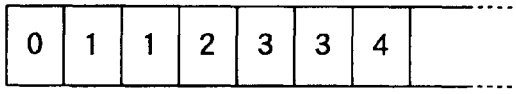
FIG. 3D PRIOR ART
Figure 3E:
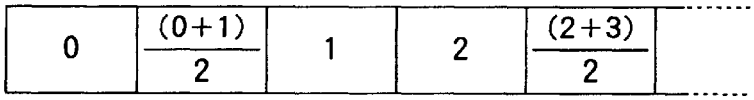
FIG. 3E PRIOR ART

It is assumed that the picture data generator 22 produces a frame which consists of five picture data as shown in FIG. 3A. The data output circuit 24 produces two or more expanded frames each of which consist of, for example, seven picture data as illustrated in FIG. 3B. In this case, the data output circuit 24 should produce two expanded frames as shown in FIGS. 3C and 3D. In addition, the LCD driver 26 drives the LCD panel 28 in response to the expanded frames so that expanded pictures which correspond to the expanded frames are alternately displayed on the LCD panel 28. As a result, it is recognized that a expanded picture which corresponds to a frame shown in FIG. 3E is displayed on the LCD panel 28 by after image. Therefore, seven pixels of the LCD panel 28 are driven by use of five picture data. Namely, the original picture is expanded into 1.4 times in the horizontal direction and displayed on the LCD panel 28.

As a result, the output circuit 24 must produce two or more expanded frames from one frame. Therefore, this circuit 24 is complicated in structure and operation.

Such a conventional driver circuit is disclosed in Japanese Patent Unexamined Publication No. 114359, 1995.

Figure 4A:
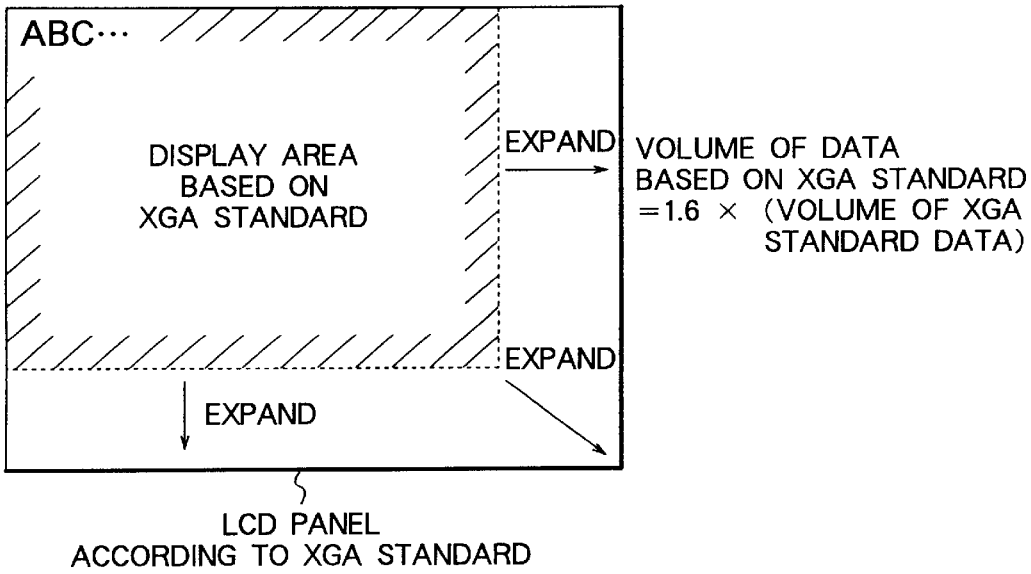
FIG. 4A shows an LCD panel displaying an expanded picture which is expanded by the driving circuit of FIG. 4B.
Figure 4B:
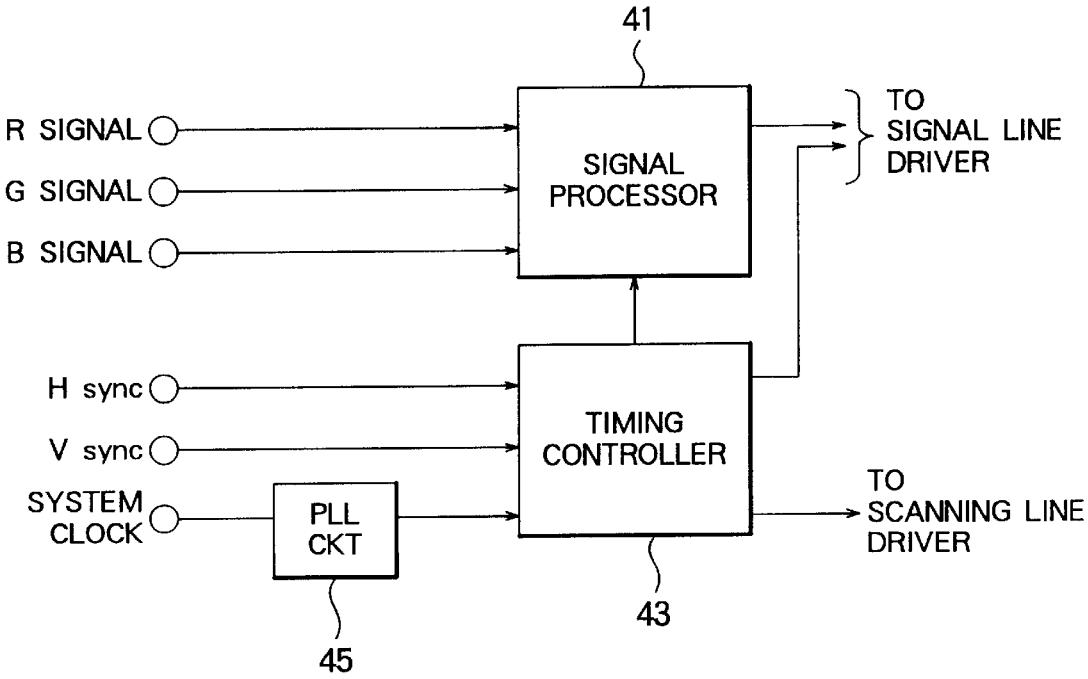
FIG. 4B is a block diagram of another conventional driving circuit.

Referring to FIG. 4B, another conventional driver has a signal processor 41 which converts analog picture signals into processed picture signals for an LCD panel (not shown). A timing controller 43 controls operation timing of the signal processor 41 in response to synchronous signals and a clock signal. A phase locked loop (PLL) circuit 45 multiplies a system clock signal and supplies a multiplied system clock signal as the clock signal to the timing controller 43.

If the LCD panel corresponds to the XGA (eXtended Graphics Array) standard for personal computer display, the LCD panel has 1024×768 pixels. On the other hand, each of the picture signals has 640×480 picture data in each frame when the picture signals correspond to a VGA (Video Graphics Array) standard for personal computer display. In this condition, the driving circuit must expand an original picture into 1.6 times in horizontal and vertical directions so that a picture is displayed on the LCD panel in full-scale. Accordingly, the PLL circuit 45 multiplies the system clock signal into 1.6 times and supplies the multiplied system clock signal to the timing controller 43. The timing controller controls the operation timing of the signal processor 41 to expand the picture into 1.6 times in the horizontal direction. The signal processor 41 produces the processed picture signal with 1024 picture data from the picture signal with 640 picture data. However, the signal processor 41 can not deal with digital picture signals.

As regards the vertical direction, an expansion method disclosed in Japanese Patent Unexamined Publication No. 158490, 1989, can be used. In the expansion method, the timing controller 43 controls a scanning line driver (not shown) so that the predetermined lines are faster than other lines by the scanning line driver. In consequence, the same data are supplied to both pixels arranged on each of the predetermined lines and pixels arranged on an adjacent line which is adjacent to each of the predetermined lines. Therefore, the original picture is expanded into 1.6 times in the vertical direction without using a line buffer or a flame buffer in the signal processor 41.

At any rate, the original picture is expanded into 1.6 times in the horizontal and the vertical directions and is displayed on the LCD panel by the full-scale as illustrated in FIG. 4A.

Referring to FIG. 5 to FIG. 11, description will be made about a driver circuit according to a preferred embodiment of this invention.

Figure 5:
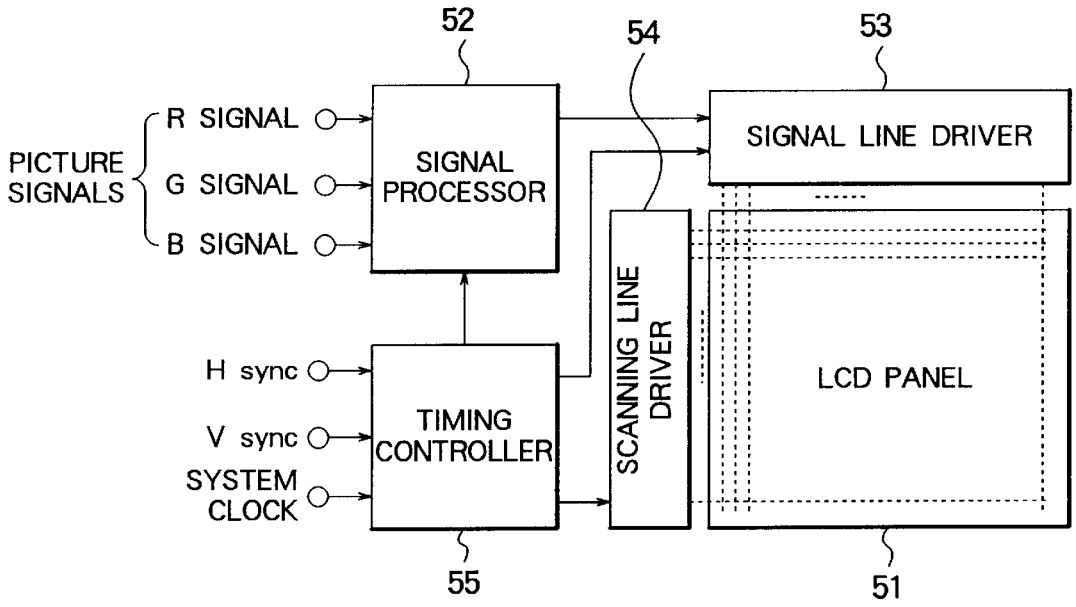
FIG. 5 is a block diagram of a driving circuit according to a preferred embodiment of this invention.

In FIG. 5, the driver circuit is connected to an LCD panel 51 which has a plurality of data buses (or signal lines) which extend vertically and a plurality of gate buses (or scanning lines) which extend horizontally. The data buses and the gate buses provides arrayed pixels at those crossing points. For example, the number of the data buses is equal to 800 and the number of the gate buses is equal to 600 according to the super VGA 1 standard.

The driver circuit comprises a signal processor 52 which corrects picture signals, i.e. an R (red) signal, a G (green) signal, and a B (blue) signal, into corrected R, G, and B picture signals which correspond to voltage—transmittance characteristics of the LCD panel 51. A signal line driver 53 is connected to one side ends of the data buses to drive the data buses in response to the corrected picture signals. A scanning line driver 54 is connected to one side ends of the gate buses to drive the gate buses. A timing controller is connected to the signal processor 52, the signal line driver 53, and the scanning line driver 54 to control operation timing of the signal processor 52, the signal line driver 53, and the scanning line driver 54 in response to a horizontal synchronous signal, a vertical synchronous signal, and a system clock signal all of which are supplied from an external circuit (not shown).

Figure 6:
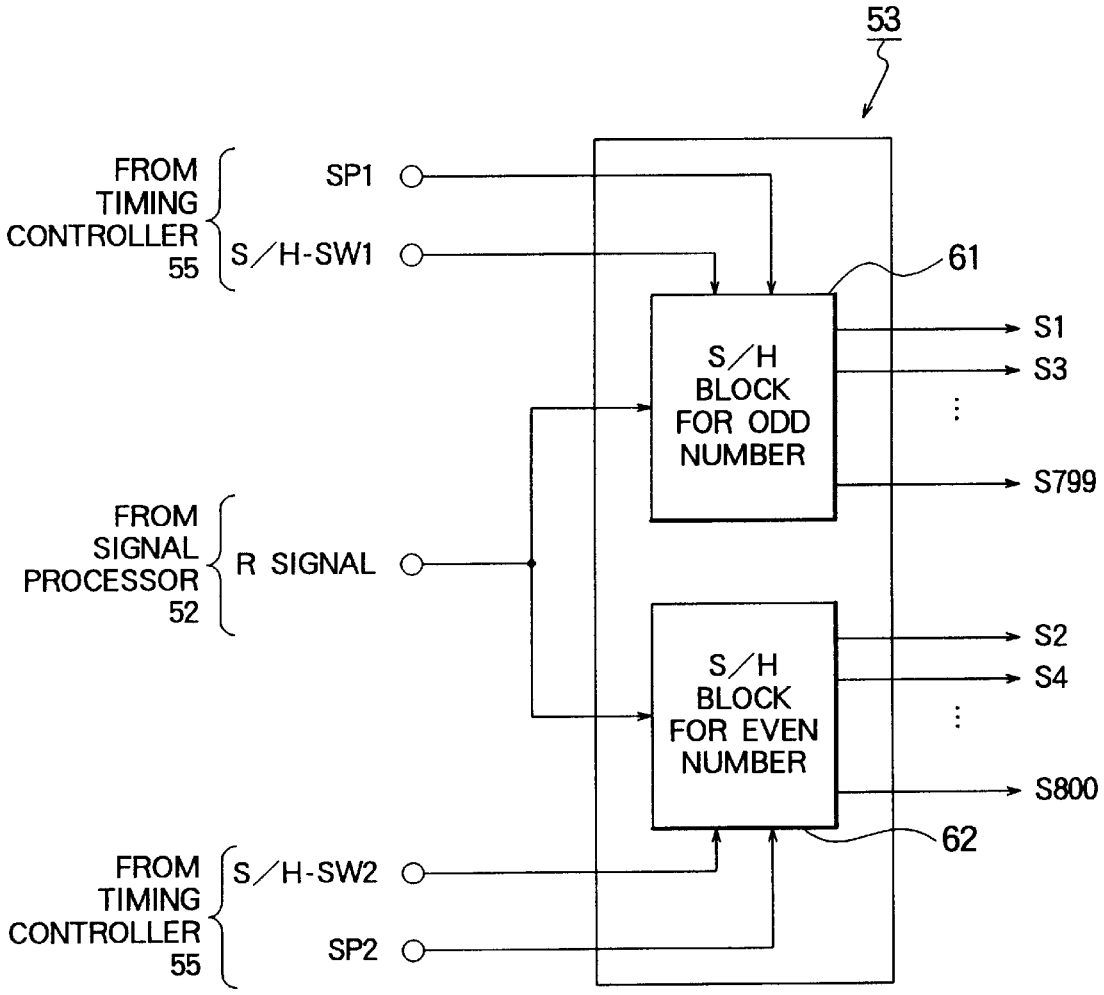
FIG. 6 is a block diagram of a signal line driver of the driving circuit of FIG. 5.

Referring to FIG. 6, the signal line driver 53 illustrated in FIG. 5 has two sample and hold circuit blocks 61 and 62 for the R signal. Similarly, the signal line driver 53 has two remaining sample and hold circuit blocks for each of the G signal and the B signal, although not shown in FIG. 6 because the remaining sample and hold circuit blocks are similar in structure to the sample and hold circuit blocks 61 and 62. Therefore, the following explanation will be restricted to the illustrated sample and hold circuit blocks 61 and 62.

The sample and hold circuit block 61 is connected to the signal processor 52, the timing controller 55, and the odd numbered data buses S1, S3, . . . , and S799 to drive the odd numbered data buses in response to a first sampling start position signal (SP1 signal), a first sample and hold switching signal (S/H SW1 signal), and the corrected R signal. On the other hand, the sample and hold circuit block 62 is connected to the signal processor 52, the timing controller 55, and the even numbered data buses S2, S4, . . . , and S800 to drive the even numbered data buses in response to a second sampling start position signal (SP2 signal), a second sample and hold switching signal (S/H SW2 signal), and the corrected R signal.

Figure 7A:
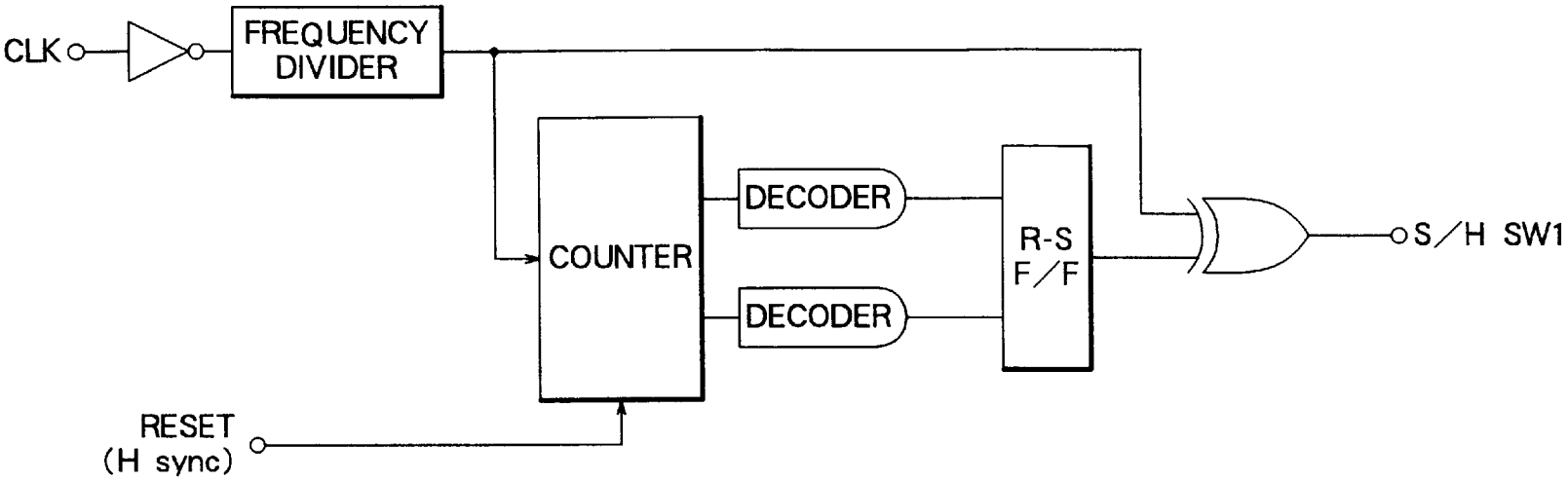
FIG. 7A is a block diagram of a circuit which produce a first sample and hold switching signal.
Figure 7B:
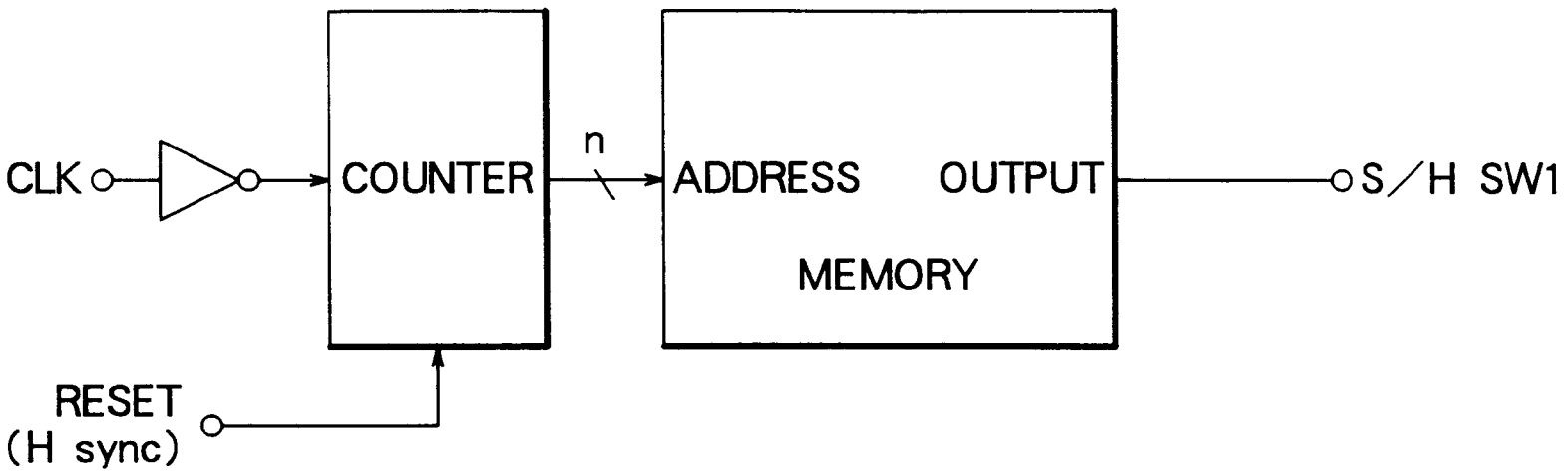
FIG. 7B is a block diagram of another circuit which produce a first sample and hold switching signal.

The SP1 and the SP2 signals and the S/H SW1 and the S/H SW2 signals are supplied from the timing controller 55. For example, the timing controller 55 has a circuit as shown in FIG. 7A or FIG. 7B so as to produce the S/H SW1 signal.

The SP1 signal is used for selecting one from the odd numbered data buses. Similarly, the SP2 signal is used for selecting one from the even numbered data buses. The S/H SW1 and the S/H SW2 signals switch operation states of the sample and hold circuit block 61 and 62 between a sampling possible state and a sampling impossible state.

As will be described later in detail, the signal line driver 53 can drive the data buses so that an original picture is expanded or enlarged into twice at maximum in a horizontal direction and an expanded picture is displayed on the LCD panel 51. The number of the sample and hold circuit blocks for each picture signal decides a maximum value of a magnification ratio in the horizontal direction.

Figure 8:
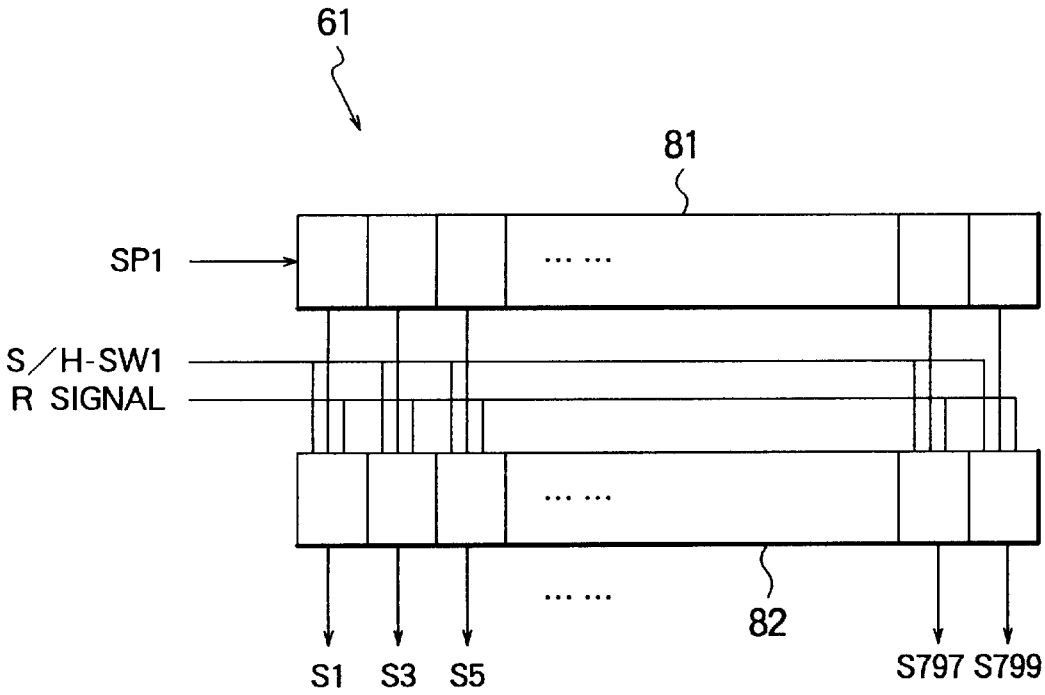
FIG. 8 is a block diagram of a sample and hold circuit block of FIG. 6.

In FIG. 8, the sample and hold circuit block 61 includes a shift register circuit 81 and a plurality of sample and hold circuits 82 connected to the shift register circuit 81 in the illustrated manner. The shift register circuit 81 has a plurality of register units. The number of the sample and hold circuits 82 is equal to the number of both the register units and the odd numbered data buses. The sample and hold circuits 82 are selectively connected to both the register units of the shift register circuit 81 and the odd numbered data buses.

Figure 9A:
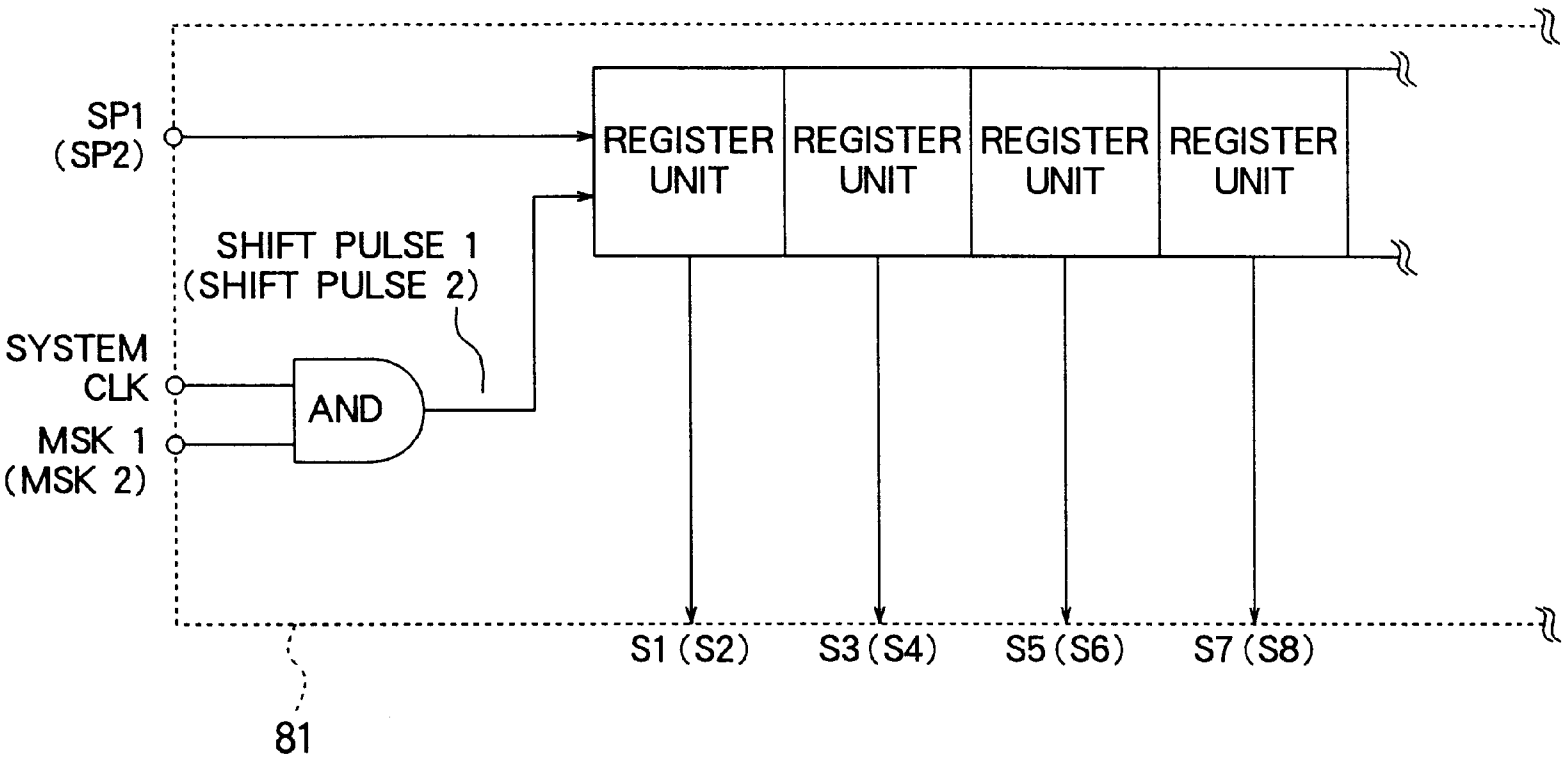
FIG. 9A is a block diagram of a shift register circuit of FIG. 8.
Figure 9B:
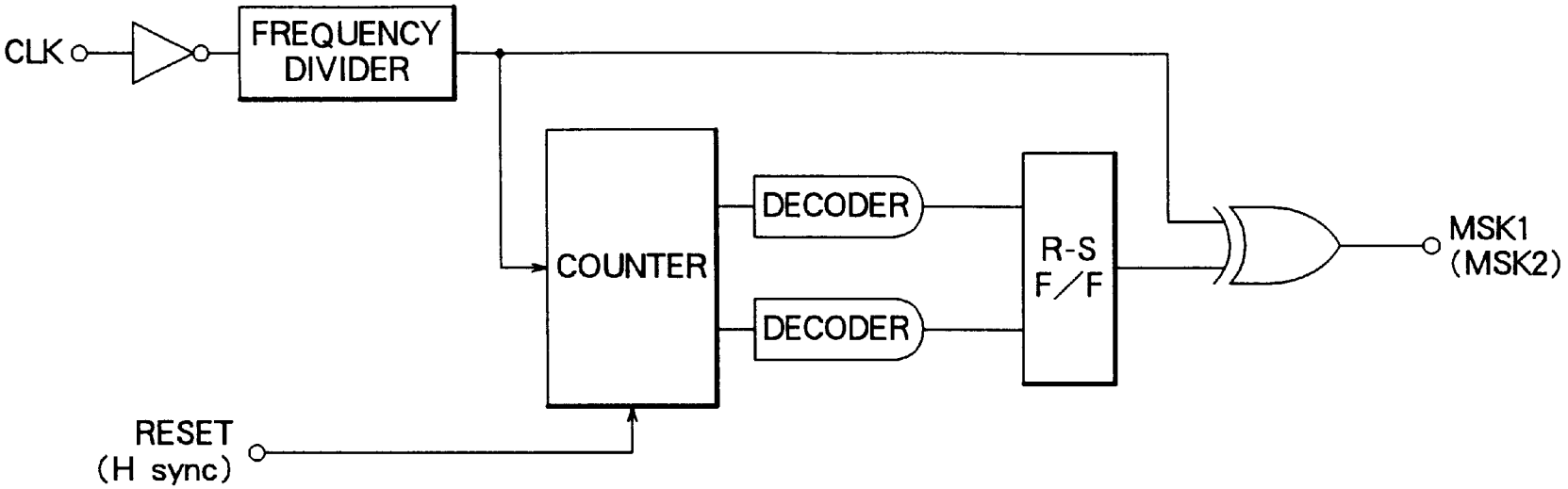
FIG. 9B is a block diagram of a circuit which produce a mask signal.
Figure 9C:
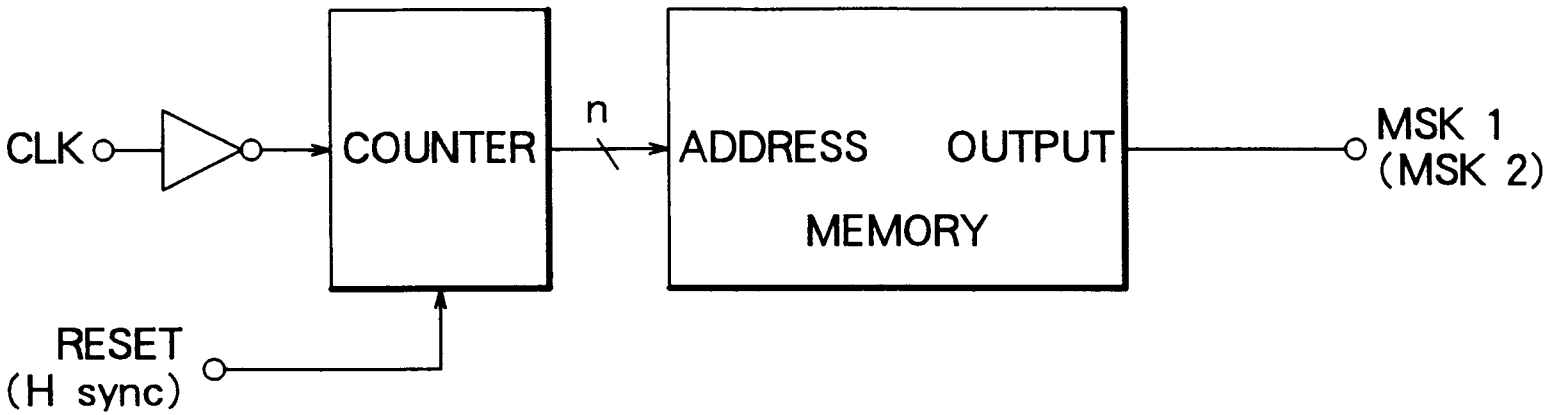
FIG. 9C is a block diagram of another circuit which produce a mask signal.

The shift register circuit 81 receives the SP1 signal and shifts the SP1 signal toward the later register unit in response to a sequence of first shift pulses produced by a AND circuit illustrated in FIG. 9A. The AND circuit receives the system clock signal and a first mask signal MSK1 sent from the timing controller 55. The timing controller 55 has, for example, a circuit illustrated in FIGS. 9B and 9C to produce the first mask signal MSK1.

Each of the register units supplies a select signal to each of the sample and hold circuits 82 when each of the register units receives the SP1 signal.

When each of the sample and hold circuits 82 receives the select signal and the S/H SW1 signal of a high level, each of the sample and hold circuits samples the corrected R signal and holds the corrected R signal to drive each of the odd numbered data buses.

The sample and hold circuit block 62 is similar in structure and operation to the sample and hold circuit block 61 and samples and holds the corrected R signal in response to the SP2 signal and S/H SW2 signal to drive the even numbered data buses.

Figure 10A:
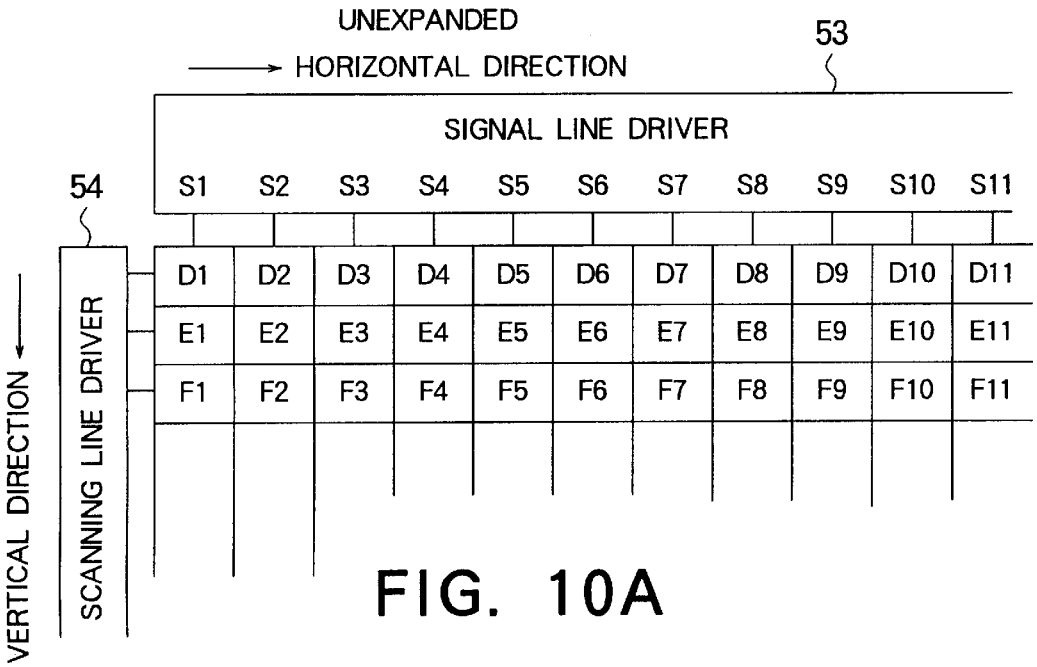
FIG. 10A shows a view for use in describing relation between pixels and data when an original picture is displayed.
Figure 10B:
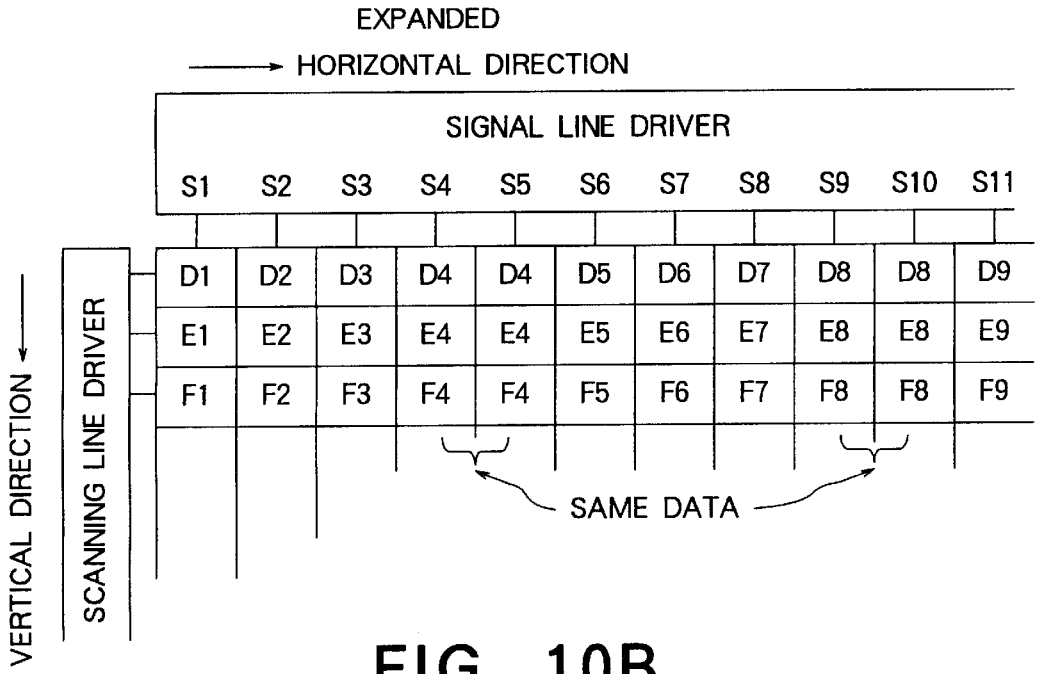
FIG. 10B shows a view for use in describing relation between pixels and data when an expanded picture is displayed.

Operation of the driving circuit will be described with reference to FIGS. 10A and 10B.

At first, an original picture is assumed to be given in the form of a series of data D1, D2, D3, . . . , D11, . . . and to correspond to the standard of the LCD panel 51. In FIG. 10A, it is assumed that the original picture is displayed on the LCD panel 51 as without expansion. In this case, the signal line driver 53 must sample the picture signals in synchronization with the clock signal (which may not be always the system clock) which has a clock period. Namely, the sample and hold circuits 61 and 62 must sample the corrected R signal alternately at every half clock period of the clock signal.

On the other hand, when the original picture does not correspond to the standard of the LCD panel 51, the original picture must be expanded to be displayed on the LCD panel 51. For example, it is surmised that the LCD panel 51 has 800 pixels in the horizontal direction while the original picture has the data series of 640 in number along each scanning line. In this event, the original picture is expanded by 1.25 times in the horizontal direction as illustrated in FIG. 10B. As shown in FIG. 10B, every fifth one of the data buses is given the data, such as D4, D8, which are the same as those on the preceding data buses, such as S4, S9. This is accomplished by modifying the operation timing of the data buses in a manner to be described in later.

Figure 11:
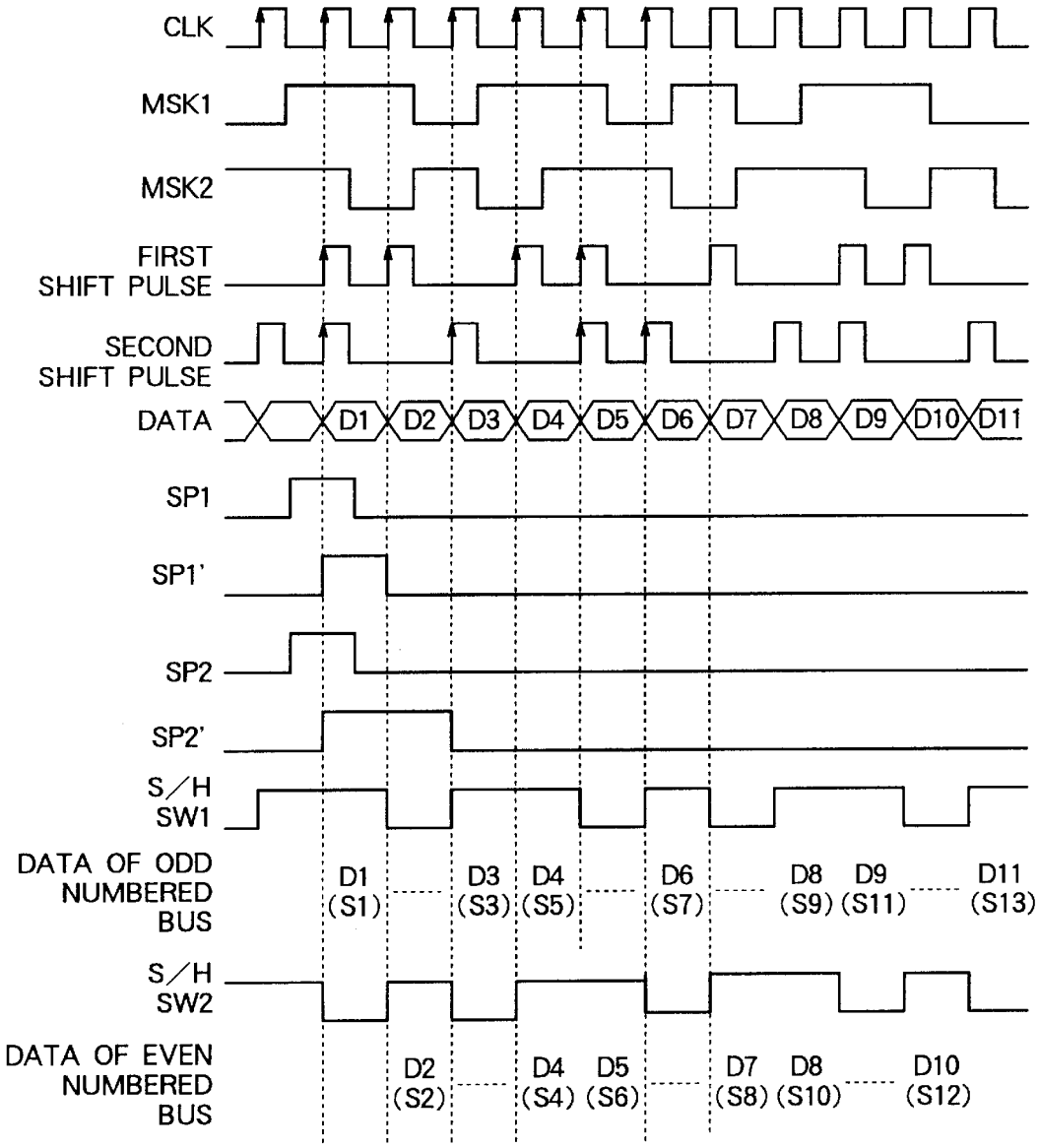
FIG. 11 is a time chart for use in describing an operation of the sample and hold circuit blocks of FIG. 6.

Referring to FIG. 11, the series of data D1, D2, D3, . . . is successively supplied from the signal processor 52 to the signal line driver in synchronism with the clock signal. The SP1 signal and the SP2 signal are supplied from the timing controller to the sample and hold circuit blocks 61 and 62, respectively. The SP2 signal is delayed by a single clock period of the clock signal relative to the SP1 signal, as shown in FIG. 11. The SP1 signal and the SP2 signal are once latched by the sample and hold circuit blocks 61 and 62 and rendered into an SP1' signal and an SP2' signal which are indicative of commencement of odd numbered data and even numbered data, respectively, and which are synchronized with the data D1 and D2, respectively. The SP1' signal is shifted by the shift register circuit 81 in response to the first shift pulse. The SP2' signal is also shifted by a shift register circuit of the sample and hold circuit block 62 in response to a second shift pulse.

The sample and hold circuit block 61 samples and holds the data D1, D3, D4, D6, D8, D9, D11, . . . in response to the SP1' signal and the S/H SW1 signal while the sample and hold circuit block 62 samples and holds the data D2, D4, D5, D7, D8, D10, . . . in response to the SP2' signal and the S/H SW2 signal. The S/H SW1 signal and the S/H SW2 signal decide a sample rate of the data in order to control a ratio of expansion. The sample and hold circuit block 61 supplies the held data D1, D3, D4, D6, D8, D9, D11, . . . to the odd numbered data buses S1, S3, S5, S7, S9, S11, S13, . . . , respectively. Similarly, the sample and hold circuit block 62 supplies the held data D2, D4, D5, D7, D8, D10, . . . to the even numbered data buses S2, S4, S6, S8, S10, S12, . . . , respectively. Herein, it is to be noted that the even numbered data D4 and the odd numbered data D5 are sent to the odd numbered data bus S5 and the even numbered data bus S8, respectively. Thus, the driver circuit drives five buses by using four data. In this way, the original picture is expanded by 1.25 times in the horizontal direction and is displayed on the LCD panel 51 as shown in FIG. 10B.

As mentioned above, this invention can display the expanded picture without a special signal processor, a frame buffer, and a line buffer. Moreover, this invention can deal with a digital picture signal and can accomplish a high quality display in spite of a simple structure.

While this invention has thus far been described in conjunction with an embodiment thereof, it will be readily possible for those skilled in the art to put this invention into practice in various other manners.

Figure 12:
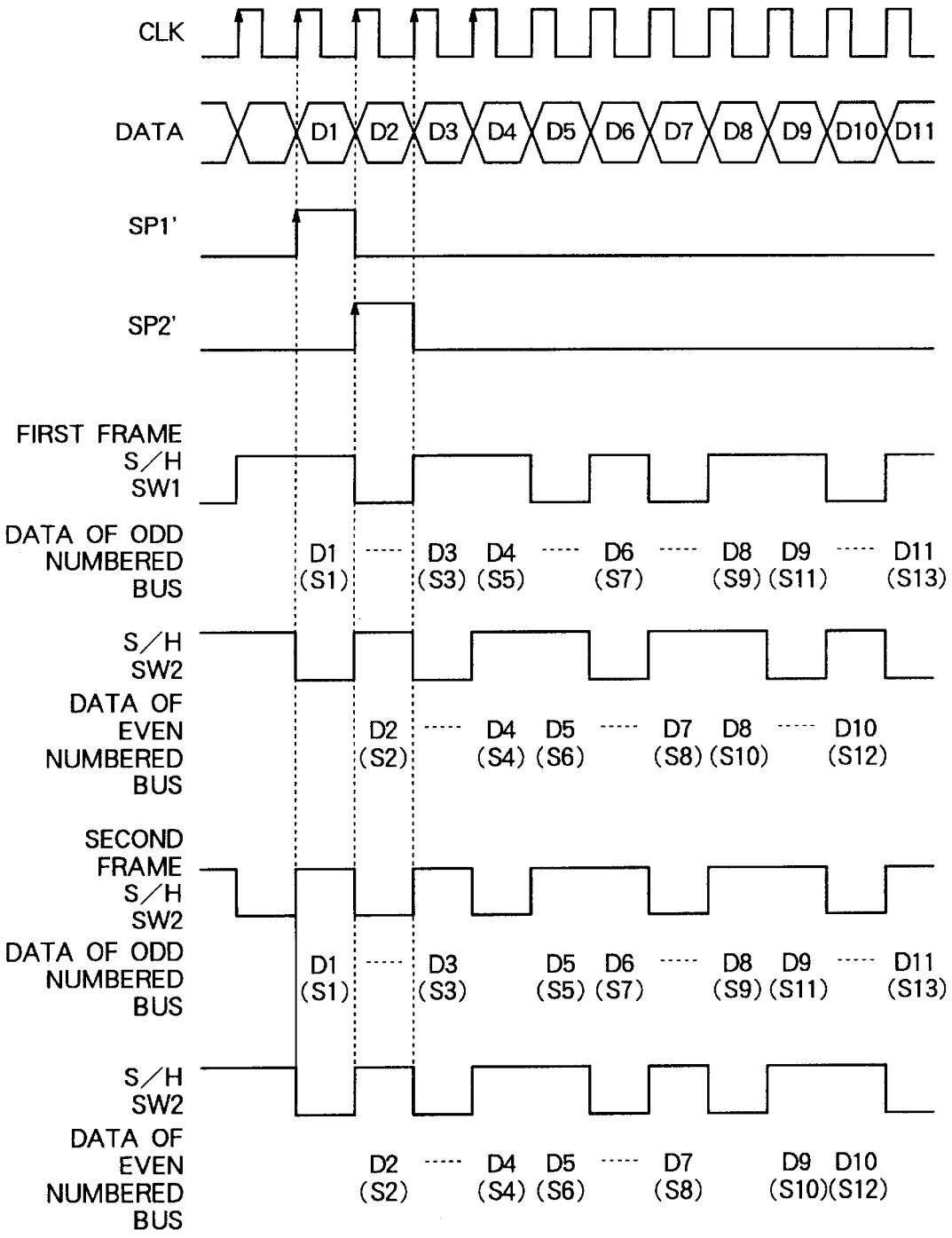
FIG. 12 is a time chart for use in describing another operation of the sample and hold circuit blocks of FIG. 6.
Figure 13A:
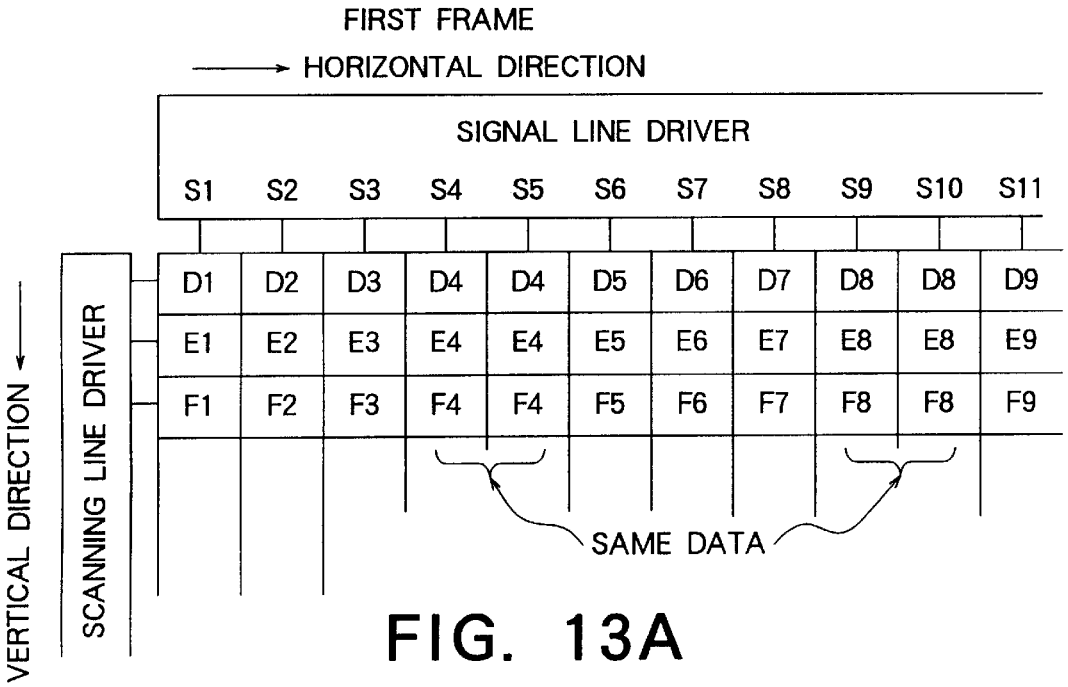
FIG. 13A shows a view for use in describing relation between pixels and data at a first frame.
Figure 13B:
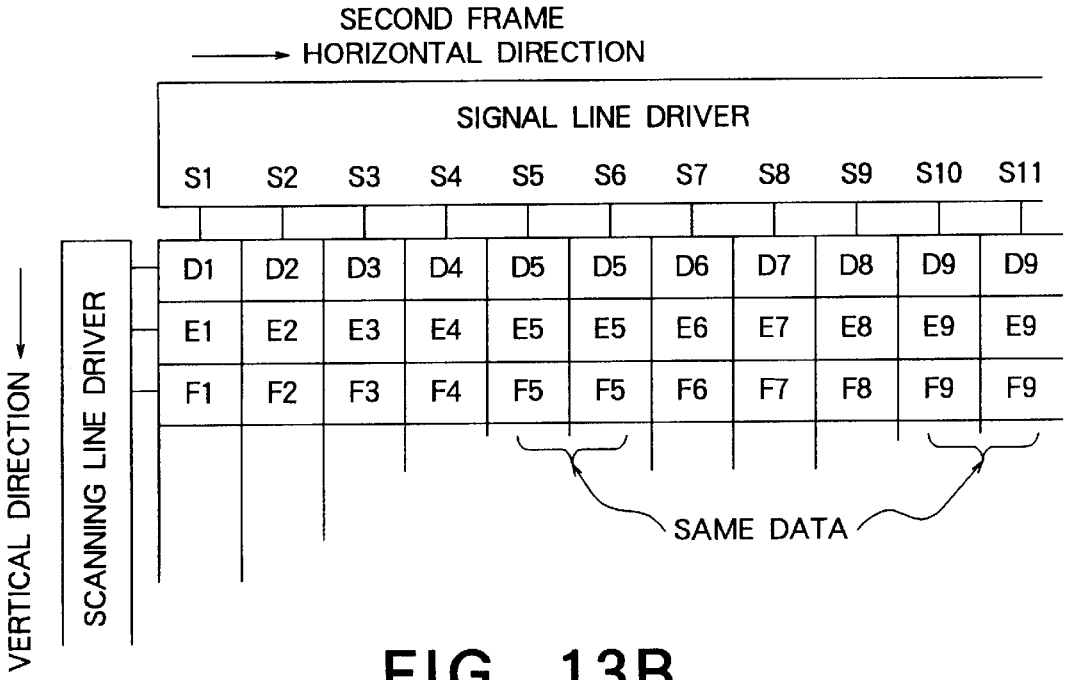
FIG. 13B shows a view for use in describing relation between pixels and data at a second frame.

For example, The S/H SW1 signal and the S/H SW2 signal may change every picture frame as illustrated in FIG. 12. In this case, the first and second shift pulses must be changed with change of the S/H SW1 and S/H SWs signals. Therefore, the expanded picture is displayed as shown in FIGS. 13A and 13B. If this method causes flicker to occur on the LCD panel, it will be solved by changing the S/H SW1 signal and the S/H SW2 signal every third picture frames. Therefore, the driving circuit produces interpolated data from two data. For example, interpolated data of (D4+D5)/2 is produced from the data D4 and D5 and interpolated data of (D8+D9)/2 is produced from the data D8 and D9.

What is claimed is:

1. A method of driving a liquid crystal display panel which has a plurality of data buses which are divided into odd numbered buses and even numbered buses, the method comprising the steps of:

determining a ratio of a number of picture elements of said liquid crystal display in a horizontal direction to a total number of picture data corresponding to a scanning line;

driving the odd numbered and even numbered buses in a first mode wherein the odd numbered and even numbered buses are driven with different picture data; and driving the odd numbered and even numbered buses in a second mode different from the first mode whereby selected adjacent data buses selected in accordance with said ratio are driven with same picture data.

2. A driving circuit responsive to a picture signal, a synchronizing signal, and a clock signal driving a liquid crystal display panel comprising a plurality of data buses, said driving circuit comprising:

a plurality of multi-stage sample and hold circuits individually connected to said data buses and divided into a plurality of groups, each group receiving said picture signal to drive said data buses, and a timing controller controlling operation timing of the groups of the sample and hold circuits in response to said synchronizing signal and said clock signal so that said data buses for the groups are independently driven;

wherein one of said groups of sample and hold circuits is operative to drive all odd numbered data buses of said liquid crystal display panel and another of said groups of said sample and hold circuits, different from the group operative to drive the odd numbered data buses, is operative to drive all even numbered data buses of said liquid crystal display panel.

3. A driving circuit responsive to a picture signal, a synchronizing signal, and a clock signal driving a liquid crystal display panel comprising a plurality of data buses, said driving circuit comprising:

a plurality of multi-stage sample and hold circuits individually connected to said data buses and divided into a plurality of groups, each group receiving said picture signal to drive said data buses, and a timing controller controlling operation timing of the groups of the sample and hold circuits in response to said synchronizing signal and said clock signal so that said data buses for the groups are independently driven;

wherein said plurality of sample and hold circuits receiving said picture signal are operatively controlled by said timing controller to provide expanded picture data to said data buses of said liquid crystal display panel such that all of a plurality of picture elements of said liquid crystal display panel are driven regardless of any disparity in size between an amount of data in said picture signal and said picture elements.

4. A driving circuit responsive to a picture signal, a synchronizing signal, and a clock signal driving a liquid crystal display panel comprising: a plurality of data buses, said driving circuit comprising:

a plurality of multi-stage sample and hold circuits individually connected to said data buses and divided into a plurality of groups, each group receiving said picture signal to drive said data buses, and a timing controller controlling operation timing of the groups of the sample and hold circuits in response to said synchronizing signal and said clock signal so that said data buses for the groups are independently driven;

wherein said picture signal comprises a data series of data samples in each one of a plurality of scanning lines, wherein each of said data samples corresponds to at least one respective picture element of said liquid crystal display panel and wherein the same data sample corresponds to two adjacent picture elements in accordance with a ratio of a number of picture elements in a horizontal direction to a number of data samples in each of said scanning lines.

5. A drive circuit capable of driving a liquid crystal display panel comprising a plurality of data buses, said driving circuit comprising:

a plurality of sample and hold circuits each sample and hold circuit having a plurality of stages individually connected to said data buses and wherein said sample and hold circuits are divided into a plurality of groups, each group receiving said picture signal to drive a subset of said data buses, and a timing controller operative to control an operation timing of the groups of the sample and hold circuits in response to said synchronizing signal and said clock signal so that said data buses for the groups are independently driven;

wherein at least one of said plurality of groups drives odd numbered data buses and at least another of said groups, different from the group driving said odd numbered data buses, independently drives even numbered data buses.

6. A drive circuit capable of driving a liquid crystal display panel comprising a plurality of data buses, said driving circuit comprising:

a plurality of sample and hold circuits each sample and hold circuit having a plurality of stages individually connected to said data buses and wherein said sample and hold circuits are divided into a plurality of groups, each group receiving said picture signal to drive a subset of said data buses, and a timing controller operative to control an operation timing of the groups of the sample and hold circuits in response to said synchronizing signal and said clock signal so that said data buses for the groups are independently driven;

wherein said sample and hold circuits are controlled to drive said data buses such that data input to said sample and hold circuits is expanded to drive a number of picture elements in a condition where the number of picture elements is larger than an amount of said data input to said sample and hold circuits.

7. A driving circuit capable of driving a liquid crystal display, said driving circuit comprising:

a signal processor operative to receive picture signals and produce corrected picture signals;

a signal line driver receiving said corrected picture signals from the signal processor; said signal line driver comprising a plurality of sample and hold blocks, each sample and hold block including a multi-stage shift register and a multi-stage sample and hold circuit wherein each stage of said shift register is operatively connected to a respective stage of said sample and hold circuit and each stage of said sample and hold circuit drives a respective plurality of picture elements of said liquid crystal display; and a timing controller receiving a system clock and independently providing timing signals to the signal processor and the signal line driver such that a number of corrected picture signals is expanded to accommodate a total number of said picture elements of said liquid crystal display.

* * * * *

UNITED STATES PATENT AND TRADEMARK OFFICE

CERTIFICATE OF CORRECTION

PATENT NO. : 6,292,162 B1
APPLICATION NO. : 08/869431
DATED : September 18, 2001
INVENTOR(S) : Tatsuya Shiki It is certified that error appears in the above-identified patent and that said Letters Patent is hereby corrected as shown below:

IN THE TITLE at (54) and above paragraph 1, column 1:

Delete "DRIVING CIRCUIT CAPABLE OF MAKING A LIQUID CRYSTAL DISPLAY PANEL DISPLAY AND EXPANDED PICTURE WITHOUT SPECIAL SIGNAL PROCESSOR" and replace with "DRIVING CIRCUIT CAPABLE OF MAKING A LIQUID CRYSTAL DISPLAY PANEL DISPLAY AN EXPANDED PICTURE WITHOUT SPECIAL SIGNAL PROCESSOR". The title should not include the word "AND" before "EXPANDED PICTURE WITHOUT..." but should instead include the word "AN".

Signed and Sealed this
Twenty-eighth Day of June, 2011

David J. Kappos

David J. Kappos
*Director of the United States Patent and Trademark Office*